US005749064A

United States Patent [19]

Pawate et al.

[11] Patent Number: 5,749,064

[45] Date of Patent: May 5, 1998

[54] METHOD AND SYSTEM FOR TIME SCALE MODIFICATION UTILIZING FEATURE VECTORS ABOUT ZERO CROSSING POINTS

[75] Inventors: Basavaraj I. Pawate, Ibaraki, Japan; Susan Yim, Richardson, Tex.

[73] Assignee: Texas Instruments Incorporated, Dallas, Tex.

[21] Appl. No.: 609,335

[22] Filed: Mar. 1, 1996

[51] Int. Cl.[6] ..... G10L 3/02; G10L 9/12

[52] U.S. Cl. ..... 704/213; 704/211

[58] Field of Search ..... 395/2.22, 2.35, 395/2.16, 2.2, 2.75, 2.09, 2.6; 704/213, 226, 207, 211, 266, 251, 200

[56] References Cited

U.S. PATENT DOCUMENTS

| | | | |
|---|---|---|---|
| 4,780,906 | 10/1988 | Rajasekaran et al. | 395/2.6 |
| 4,856,068 | 8/1989 | Quatieri et al. | 395/2.36 |
| 5,175,769 | 12/1992 | Hejna et al. | 395/2.2 |
| 5,216,744 | 6/1993 | Alleyne et al. | 395/2.09 |
| 5,327,521 | 7/1994 | Savic et al. | 395/2.81 |
| 5,473,759 | 12/1995 | Slaney et al. | 395/2.75 |
| 5,504,833 | 4/1996 | George et al. | 395/2.2 |

*Primary Examiner*—Allen R. MacDonald
*Assistant Examiner*—Richemond Dorvil
*Attorney, Agent, or Firm*—Robert L. Troike; Tammy L. Williams; Richard L. Donaldson

[57] ABSTRACT

A method and system for implementing time scale modification wherein the method includes a Zero Crossing Module (22) for determining zero crossing points in the signal, a Feature Vector Module (24) for generating feature vectors describing the zero crossing points, a Distance Metric Module (26) for generating distance metrics describing local characteristics at the zero crossing points, an Alignment Module (28) for using the feature vectors and distance metrics for aligning and synchronizing the signal in accordance with local similarities and similarity over a selected time interval to generate a time scale modified signal. The present invention also includes a Cross Fade Module (20) for smoothing transitions between successive frames of the resulting time scale modified signal.

8 Claims, 4 Drawing Sheets

ORIGINAL SIGNAL

EXPANDED BY 20%

CONTRACTED BY 20%

ORIGINAL SIGNAL

EXPANDED BY 20%

CONTRACTED BY 20%

ORIGINAL SIGNAL

EXPANDED BY 20% WITHOUT PRE-SEARCH USING ZERO-CROSS RATE

EXPANDED BY 20% WITH PRE-SEARCH USING ZERO-CROSS RATE

METHOD AND SYSTEM FOR TIME SCALE MODIFICATION UTILIZING FEATURE VECTORS ABOUT ZERO CROSSING POINTS

TECHNICAL FIELD OF THE INVENTION

This invention relates to signal processing and more specifically to a method and system for time scale modification.

BACKGROUND OF THE INVENTION

Time Scale Modification (TSM) of signals is an important component in many speech coding and music applications. For example, in a karaoke system the user is allowed to change the key of the background music to match his/her key. TSM is a component in this key changing algorithm. Karaoke systems also include a pitch-shifting function which uses TSM to maintain its original tempo after resampling. One method of implementing TSM is using a Synchronized Overlap and Add (SOLA) algorithm which includes numerous cross-correlation calculations. Whereas the SOLA algorithm gives acceptable audio quality, the large number of computations inherent in the cross-correlation calculation prevents a single-chip implementation. Hence the need to investigate alternate methods for implementing TSM.

There are many other approaches to modify the time scale of a signal other the SOLA method [see, for example, S. Rovcos and A. M. Wilgus, "High Quality Time Scale Modification for Speech", *IEEE Int. Con. Acoust., Speech, Signal Processing,* March 1985, pp. 493–496 (hereinafter "Roucos, et al."); and see also J. Makhoul and A. E. Jaroudi, "Time-Scale Modification in Medium to Low Rate Speech Coding", *IEEE Int. Con. Acoust., Speech, Signal Processing,* 1986, pp. 1705–1708 (hereinafter "Makhoul, et al.")].

One approach is the least-squares error estimation from the modified short-time Fourier transform magnitude (LSEE-MSTFTM) [see D. W. Grffin and J. S. Lim, "Signal Estimation from Modified Short-Time Fourier Transform", *IEEE Trans. Acoust., Speech, Signal Processing,* Vol. ASSP-32, pp. 236–243, April 1984 (hereinafter "Griffin, et al.")]. The short-time Fourier transform magnitude (SFTM) algorithm contains both pitch and envelope information. This algorithm iteratively estimates the desired time-scale modified SFTM.

Another approach is based on a sinusoidal model where a signal is represented as an excitation component and a system function [see Quatieri and R. S. McAulay, "Speech Transformation Based on a Sinusoidal Representation", *IEEE Int. Conf. Acoust., Speech, Signal Processing,* March 1985, pp. 489–492 (hereinafter "Quatieri, et al.")]. The excitation signal is further decomposed into sinusoids. TSM is achieved by time-scaling the system amplitudes and phases and by times-scaling the excitation amplitudes and frequencies.

While each of the methods discussed hereinabove produce high quality signals, they require more computations in comparison to the SOLA method.

A simple yet elegant way of achieving the necessary TSM is using an Overlap and Add (OLA) algorithm. The OLA algorithm is a time domain based approach in which successive frames are overlapped and added—hence the term Overlap and Add. This technique is explained briefly hereinbelow in conjunction with discussion of SOLA, a derivative of the OLA algorithm.

Simple shifting and adding frames can achieve the purpose of modifying the time scale. However, it does not conserve the pitch periods or the spectral characteristics of the signal. Therefore, poor quality signal characteristics such as clicks, burst of noise, or reverberation are likely to result. To prevent these undesirable effects, it is necessary to have a smooth transition at the point where successive frames are concatenated and a similar signal pattern between the two frames in the duration of the overlapping interval. In other words, the two frames have to be synchronized at the point of highest similarity.

The SOLA method (see Makhoul, et al.) performs the operation entirely in the time domain and does not require pitch estimation. The SOLA method is based on the simpler OLA method where frames of signal are shifted and added, but in SOLA the frames of a signal are shifted and added in a synchronized manner. This conserves the pitch periods and spectral characteristics of the original signal.

The SOLA method reconstructs the output signal on a frame-by-frame basis. In the SOLA algorithm, two frame intervals, an analysis frame interval Sa and a synthesis frame interval Ss, are related by a time scale factor $\alpha$ as shown hereinbelow in equation (1). Compression is achieved if $\alpha$ is less than one and expansion is achieved if $\alpha$ is greater than one.

$$Ss=Sa\times\alpha \tag{1}$$

TSM is achieved by extracting N samples from the input signal x[n] at interval Sa and constructing signal y[n] at every Ss examples. In the process of synthesis, the new analysis frame ($m^{th}$ frame of the input signal: x[mSa+j], 0<j<N) is added along the previously constructed signal (y[mSs+k], $k_{min}<k<k_{max}$) until a region with highest similarity is located. Then, this analysis frame is overlapped and added to the previously computed reconstructed signal y[n]. The interval [$k_{min}$, $k_{max}$] has to span at least one period of the lowest frequency component of the signal.

It is essential that the overlapping region possesses a similar signal pattern otherwise the listener will detect a fluctuation of signal level or noise and reverberation in the reconstructed signal due to the discontinuity at the point of concatenation. An example is shown in FIG. 1. When two signals are not aligned at the point of highest similarity, an extraneous pulse appears after the two signals are overlapped and added.

SOLA uses the normalized cross-correlation as a measure of correlation between the two signals. A large value will indicate a high similarity in signal pattern between the two signals. Hence, as the new analysis frame is being slided along the previously constructed signal, the normalized cross-correlation for that instance is calculated. Finally, the index with the maximum value is selected. This method provides good result, however, it involves a large amount of computations since a new correlation value has to be computed for each index as the analysis frame moves along. Therefore the SOLA algorithm is difficult to implement in real-time on a single Digital Signal Processing (DSP) chip.

Thus, what is needed is a method and system to achieve the necessary TSM (compression or expansion) of an input signal without destroying the pitch information present in the input signal. The output signal should be clean without any artifacts such as clicks.

What is also needed is method and system that perform the necessary TSM while requiring the least amount of computations such that it can be realized on a single DSP such as TMS320C25LP or DASP3.

SUMMARY OF THE INVENTION

The present invention is a method and system for implementing time scale modification of a signal using time domain measures which include zero-crossing and slope. The present invention also includes the definition and use of a feature vector and a distance metric which permit searching for and concatenate of similar segments of the signal. While a significant portion of computation time is spent in searching for similar segments of the signal, the dimension of the feature vector and the distance metric strongly influence the computation time. Furthermore, systems implementing the present invention are capable of producing a signal with the desired time scale while maintaining the pitch periodicity of the original signal.

DESCRIPTION OF THE DRAWINGS

These and other features of the invention that will be apparent to those skilled in the art from the following detailed description of the invention, taken together with the accompanying drawings in which.

DETAILED DESCRIPTION OF THE INVENTION

The present invention provides for a computationally efficient algorithm for time scale modification of a signal using an Overlap and Add (OLA) method for achieving the necessary time scale modification and a novel time alignment or synchronization algorithm for preserving pitch information.

The present invention synchronizes or time-aligns two frames of the signal based on local similarity and similarity over a time-interval or window. Local similarity, as used in the present invention, is defined as similarity round a sample point. Time-interval similarity, as used in the present invention, is defined as similarity over an interval of time. As discussed in more detail hereinbelow, the method and system of the present invention achieve alignment in two steps. First, a search for time-interval similarity is performed. Then, the present invention provides for a search for a local similarity in the neighborhood of the best time interval similarity region.

Figure 1:
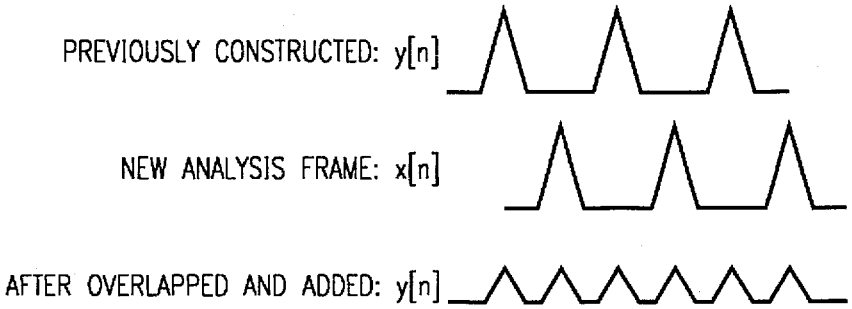
FIG. 1 shows overlap and add of two originals without synchronization.
Figure 2:
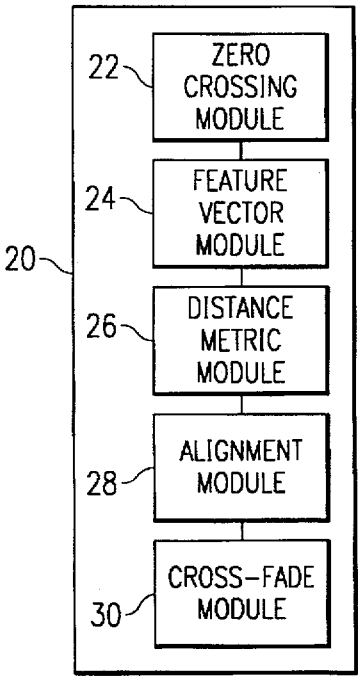
FIG. 2 is a block diagram illustrating the present invention.

One embodiment of a TSM system in accordance with the present invention is shown in the block diagram shown in FIG. 2. As shown in FIG. 2, the TSM system in accordance with the present invention operates on processor 20 which is a digital signal processor but it is contemplated that other processor types may be used. The system in FIG. 2 also includes a Zero Crossing Module 22 for determining the zero crossing points in the signal. Connected to the Zero Crossing Module 22 is a Feature Vector Module 24 for determining feature vectors, each of which describes properties, or local characteristics, of each of the zero crossing points. The Feature Vector Module 24 is in turn connected to a Distance Metric Module 26 for defining a distance metric which measures the closeness of local characteristics between two zero crossing points.

Figure 3:
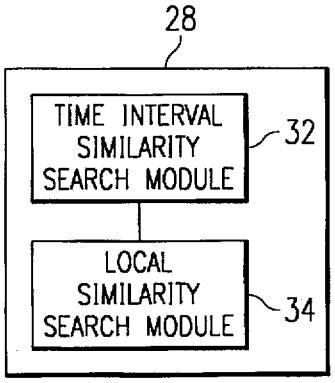
FIG. 3 is shows a block diagram of the alignment module of the present invention.

FIG. 2 further includes an Alignment Module 28, coupled to the Distance Metric Module 26, for determining the best point of alignment between the two signals using the zero crossing points and aligning the signals accordingly as shown in FIG. 3, the Alignment Module 28 includes a Time Interval Similarity Search Module 32 and a Local Similarity Search Module 34. Finally, connected to the Alignment Module 28 is a Cross-Fade Module 30 which uses the feature vectors to smooth transitions between successive frames in the resulting signal after alignment. Each of these features are discussed in more detail hereinbelow.

Using the Zero Crossing Module 22, to find the zero crossing points, the properties of a signal are measured at zero crossing points noting that the zero crossings rate of a signal is a crude measure of its frequency content. In aligning two frames using the Alignment Module 28, the Time Interval Similarity Search Module 32 is used to search for a time-interval similarity using the zero crossings rate as a signal measure. In searching for a local similarity position using the Local Similarity Search Module 34, local properties of the signal are measured at the points of zero crossings. These local properties include, for example, slope and absolute magnitudes of the signal at a zero crossing point. The zero crossing rate is a good parameter for representing the signal property over an interval of time. Parameters like slope and absolute magnitude are good measures for representing local behavior.

In the Zero Crossing Module 22, a zero-crossing exists if there is a change in algebraic sign between two successive samples. Hence, the number of zero cross points in a period of [1,L] is defined as:

$$Z=\sum_{m=1}^{m=L}|\mathrm{sgn}(x[m])-\mathrm{sgn}(x[m+1])|$$

where sgn(x[m])=1 if x[m]<0 and where sgn(x[m])=0 if x[m]≦0.

In the Feature Vector Module 24, an eleven dimensional feature vector is generated to represent local information of each zero-crossing point determined using the Zero Crossing Module 22. The components are comprised of the slopes and the absolute magnitudes at the zero-crossing point and its neighborhood. If, for example, the zero-crossing occurs between x[i] and x[i+1], then the eleven dimensions, f1, f2, . . . , f11, of the eleven dimensional feature vector are:

$$f1 = x[i] - x[i+1];$$
$$f2 = |x[i]|;$$
$$f3 = |x[i+1]|;$$
$$f4 = \frac{(x[i] - x[i+2])}{2};$$
$$f5 = |x[i+2]|;$$
$$f6 = \frac{x[i] - x[i+3]}{3};$$
$$f7 = |x[i+3]|;$$
$$f8 = \frac{(x[i-1] - x[i+1])}{2};$$
$$f9 = |x[i-1]|;$$
$$f10 = \frac{x[i-2] - x[i+1]}{3}; \text{ and}$$
$$f11 = |x[i-2]|$$

where |x| represents the absolute magnitude of x.

Figure 4:
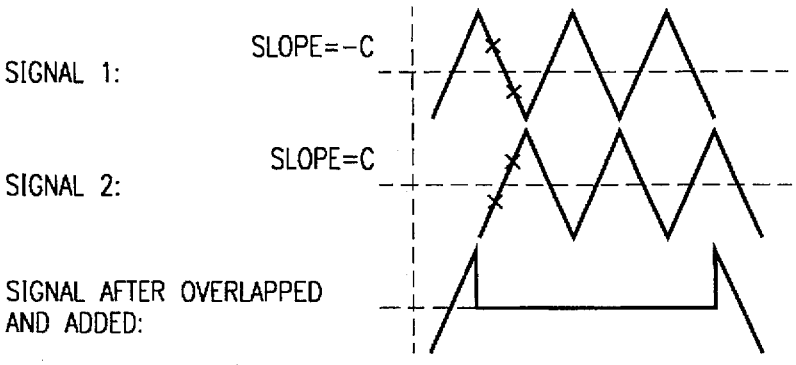
FIG. 4 is depicts three signals which illustrate the importance of slope direction and absolute magnitude.

In the Distance Metric Module 26, there is a good match between two zero crossing points if the feature vectors, as defined by the Feature Vector Module 24 discussed hereinabove, associated with each of the two zero crossing points is similar. Hence, the difference in the feature vectors can be used as a measure of the closeness of local characteristics between the two zero crossing points. Distance metric, $d_{k,i}$, determined using the Distance Metric Module 26, is defined as:

$$d_{k,i} = \frac{1}{11} \sum_{j=1}^{11} |f_x[j] - f_{y,i}[j]|$$

where k is the index where zero crossing starts, $f_x[j]$ is the $j^{th}$ component of the feature vector associated with a zero crossing point in x[n] and $f_{yi}[j]$ is the $j^{th}$ component of the feature vector associated with the $i^{th}$ zero crossing point in y[n]. These components are chosen since they approximately indicate the smoothness when two signals are joined. For example, the importance of slope direction and absolute magnitude are illustrated in the signals shown in FIG. 4.

Once the zero crossing points, the feature vectors and the distance metrics are determined using the Zero Crossing Module 22, the Feature Vector Module 24 and the Distance Metric Module 26, respectively, the Alignment Module 28 is used to determine the best point of alignment.

The determination of the best point of alignment, as performed by the Alignment Module 28, is carried out in two separate stages based on the zero crossing points. The two stages include a search for an analysis frame and synchronization. During the search for the analysis frame m, the $m^{th}$ analysis frame of x[n], where $mSa \leqq n < mSa+N$. the new analysis frame is shifted along y[mSs+k] over the range $k_{min} \leqq k \leqq k_{max}$. The values $k_{min}$ and $k_{max}$ are chosen such that they are symmetrical about the point y[mSs]. The limit for $k_{min}$ and $k_{max}$ are as described hereinabove. It is also noted that the frame size N has to be larger than four times $k_{max}$ to achieve good performance. The final cross-fade function, described hereinbelow in connection with the Cross Fade Module 30, is used to provide a smoother and more natural transition between adjacent frames.

The next step performed by the Alignment Module 28 is synchronization. Synchronization for each frame is achieved in two separate stages. First, the zero crossing rate is used as an initial estimation and, secondly, the final alignment is then refined by choosing the minimum distance metric, $d_{k,i}$, between a zero cross point of x[n] and a zero crossing point of y[n].

In the first stages of the synchronization step performed by the Alignment Module 28, the number of zero crossing points is used to provide duration information. An index $k_{zmin}$ is determined such that the difference, $C_k$, in the number of zero crossing points between the signal x[n] and the signal y[n] in overlapping interval L, as shown in the equation hereinbelow, is minimal. This suggests that x[n] and y[n] have approximately the same waveform in the interval L. Accordingly, $$C_k = \sum_{n=0}^{L} |\mathrm{sgn}(x[n]) - \mathrm{sgn}(x[n+1])| - \sum_{n=mSs+k}^{mSs+k+L} |\mathrm{sgn}(y[n]) - \mathrm{sgn}(y[n+1])|$$

where k is the index by which the analysis frame, m, is shifted relative to the point y[mSs]. Since the overlapping interval, L, changes for each k, a new value has to be computed. However, this computation does not increase the computational load dramatically since as the index k varies from $k_{min}$ to $k_{max}$, the number of zero crossing points is accumulated.

In the second stage of the synchronization step performed by the Alignment Module 28, the distance metric $d_{c,i}$ is used to indicate similarity between two zero crossing points locally. It is observed that a wrong match at a zero crossing point with a large slope has a more pronounced effect than at a zero crossing point with a small slope. Therefore, the zero crossing point with the largest slope, $x[k_{max}]$, is selected. Then, the selected zero crossing point is compared with each zero crossing point in y[n] over a certain range by means of the distance metric, $d_{k,i}$.

Let m, $k_{zmin}$, $k_{smax}$, and $k_{minfound}$ denote current frame number, initial estimated position, index where a zero crossing point has the maximum slope and best point of alignment, respectively. The procedures performed by the Alignment Module 28 are then as follows:

1. Find $k_{max}$ from the zero crossing points of x[n], where $mSa \leqq n < mSa+2k_{max}$ , such that $|x[mSa+k_{smax}]-x[mSa+k_{smax}+1]|$ gives the maximum slope.
2. Locate all zero-cross points from y[mSs+j], where $K-T \leqq j \leqq K+T (K=K_{zmin}+k_{smax})$, such that T spans a time interval of approximately 10 ms. This interval, however, should have a lower boundary, kmin, and an upper boundary $k_{max}$ where $k_{min} \leqq K-T \leqq k_{max}$, such that the determined best point of alignment, $k_{minfound}$, still lies within the region of $k_{min} \leqq k_{minfound} \leqq k_{max}$.
3. Search for a zero crossing point in y[n] which is most similar when compared to the zero crossing point $x[mSa+k_{max}]$ and its neighborhood. Compute the distance metric $d_k$ between $x[mSa+k_{max}]$ and each zero crossing point in y[n] detected in step 2. However, if any slope in the feature vector between two zero crossing points are of opposite direction, then that zero crossing point is discarded immediately to avoid an erroneous situation such as that illustrated in FIG. 4 to occur.
4. Choose the index $k_{minfound}$ which gives the minimum distance measure.

Once the best point of alignment is determined using the Alignment Module 28, the output signal is constructed by averaging the two frames x[mSa+i] and y[mSs+j], where $0 \leqq i < L$, $k_{minfound} \leqq j < k_{minfound}+L$, and then by attaching the rest of the N-L samples in x[n] to the output as shown in the following equations:

$$y[mSs+k_{minfound}+j] = (1-c[j])y[mSs+k_{minfound}+j] + c[j]x[mSa+j], \text{ if } 0 \leqq j < L, \text{ and}$$

$y[mSs+k_{minfound}+j]=x[mSa+j]$, if $L \leqq j \leqq N-1$ where $$c[j]=-0.5\left(\cos\left[\frac{\pi j}{L}\right]+0.5\right).$$

Simply averaging the two waveforms in the overlapping region will not provide a very smooth transition. Hence, the raised cosine function, c[j], which allows reasonably smooth fade-in and fade-out, is chosen.

Figure 5A:
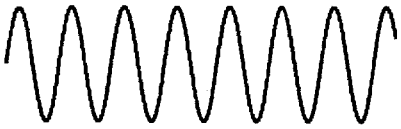
FIGS. 5A–5C show test signals illustrative of the performance of the zero crossing process implemented in the present invention.
Figure 5B:
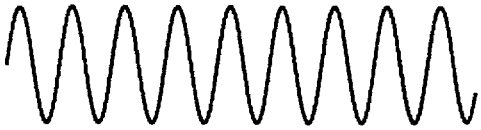
Figure 5C:
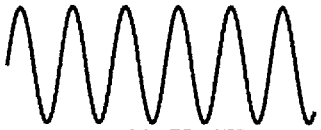
Figure 6A:
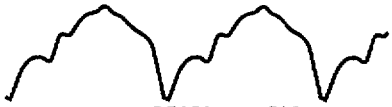
FIGS. 6A–6C depict other test signals illustrative of the performance of the zero crossing process implemented in the present invention.
Figure 6B:
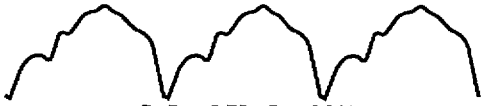
Figure 6C:
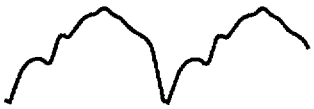

Some test signals were chosen to evaluate the performance of the zero crossing algorithm for TSM implemented using the present invention. In FIG. 5A, the original signal, a single sinusoid, is shown. FIGS. 5B–C show time scaled versions of the single sinusoid signal shown in FIG. 5A. In FIG. 5B the single sinusoid signal has been expanded by about 20%. In FIG. 5C the single sinusoid signal has been contracted by about 20%. Similarly, FIG. 6A shows a waveform extracted from an electronic keyboard. FIGS. 6B–C show time scale versions of the waveform extracted from an electronic keyboard shown in FIG. 6A. The waveform shown in FIG. 6B has been expanded by about 20%. The waveform shown in FIG. 6C has been contracted by about 20%. Thus, it is observed that the zero crossing algorithm implemented in the present invention preserves the pitch period of the signal.

Figure 7A:
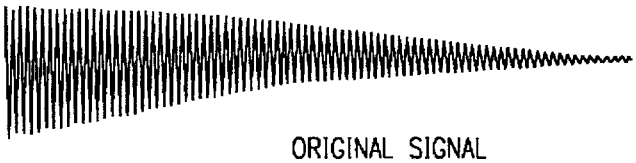
FIGS. 7A–7C depict signals illustrating measurement of similarity of an interval.
Figure 7B:
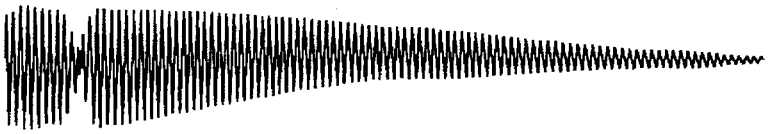
Figure 7C:
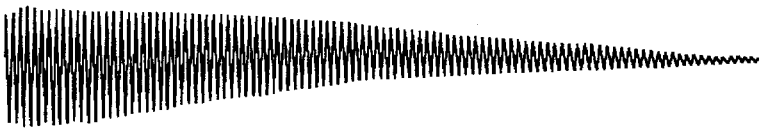

The importance of using the zero crossing rate as a measure of similarity in an interval is illustrated in FIG. 7. The original signal is shown in FIG. 7A. A resulting discontinuity due to lack of interval match is shown in the signal in FIG. 7B which has been expanded by about 20% without pre-search using the zero-crossing rate. Then, in FIG. 7C, the improvement gained from determining interval similarity and using to expanding the signal by 20% is evident.

Thus, the present invention implements a computationally efficient algorithm for time scale modification using the principle of Overlap and Add (OLA) for achieving the necessary time scale modification. Synchronization for preserving pitch periods is attended by assuring local similarity and similarity over a time-interval based on the information derived from the zero crossing points of a signal. Results show that an implementation in accordance with the present invention is capable of reproducing signals with the desired time scale while maintaining the pitch periodicity of the original signal.

Next some issues involved in implementing the present invention where the processor 20 is on a 16 bit fixed point digital signal processor, such as a TMS320C52 DSP, a product of the assignee, Texas Instruments Incorporated, are explored. Also, insights and further understandings gained with respect to the overlap and add method, such as the importance of cross fade gain and the effects of varying the overlapping period, are discussed.

The performance of the present invention when incoming signals are sampled at 44.1 kHz has also been tested extensively by using a variety of input music signals such as an electronic keyboard, string instruments, wind instruments and a combination of background music with singing voices. In all of the above mentioned test signals, the present invention produces good audio quality signals at a 44.1 kHz sampling rate with a larger saving in computational load when compared to the cross-correlation method.

There are two aspects, however, to consider when implementing the present invention on a real system (e.g. one using a PCMCIA card with the TMS320C52 DSP). First, since only limited memory space is available on the hardware, a buffering scheme is used to allow continuos input and output samples from a codec without affecting operations. Second, since the TMS320C52 DSP is a 16-bit fixed point digital signal processor, all mathematical operations are performed in fixed point and all variables are represented using 16 bits.

Figure 8:
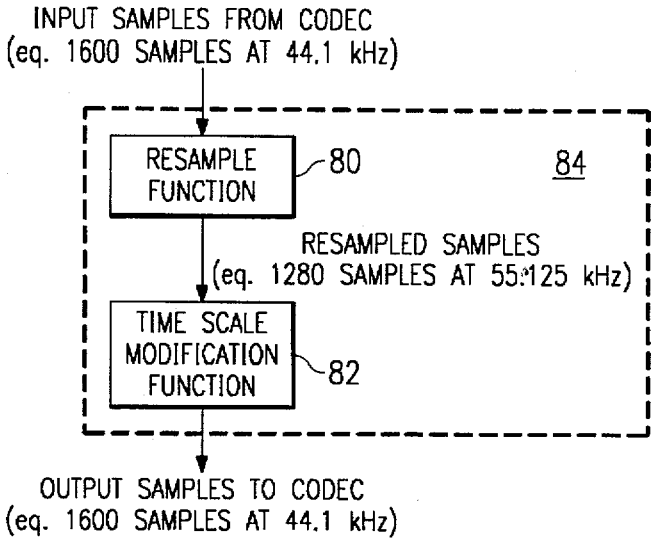
FIG. 8 shows a block diagram of a key shifting function which uses the present invention.

In the TSM algorithm of the present invention, the input and output streams are at different sampling rates. However, the same sampling frequency is needed for both input and output in a real system. Therefore, FIG. 8 shows the TSM Function 82 in accordance with the present invention coupled with a resample function 80 to provide a key-shifting function 84, where the resampling Function 80 will alters the pitch and the TSM function 82 maintains the original time scale. FIG. 8, is the operations performed on a frame-by-frame basis. The key-shifting function 84 reads in ss samples per frame, the resample function 80 resamples the ss samples to give sa samples, then the TSM function 82 time scales the sa samples to ss samples.

The TSM function 82 operates on N input samples from the current frame, $k_{min}$ output samples from the previous frame and $k_{max}$+N ($k_{max}$=$k_{min}$) output samples from the current frame. In the TSM function 82, N is set to twice the size of ss or sa depending on the time scale factor, where expansion or contraction is performed. The buffering scheme is shown in more detail in FIG. 9.

Figure 9:
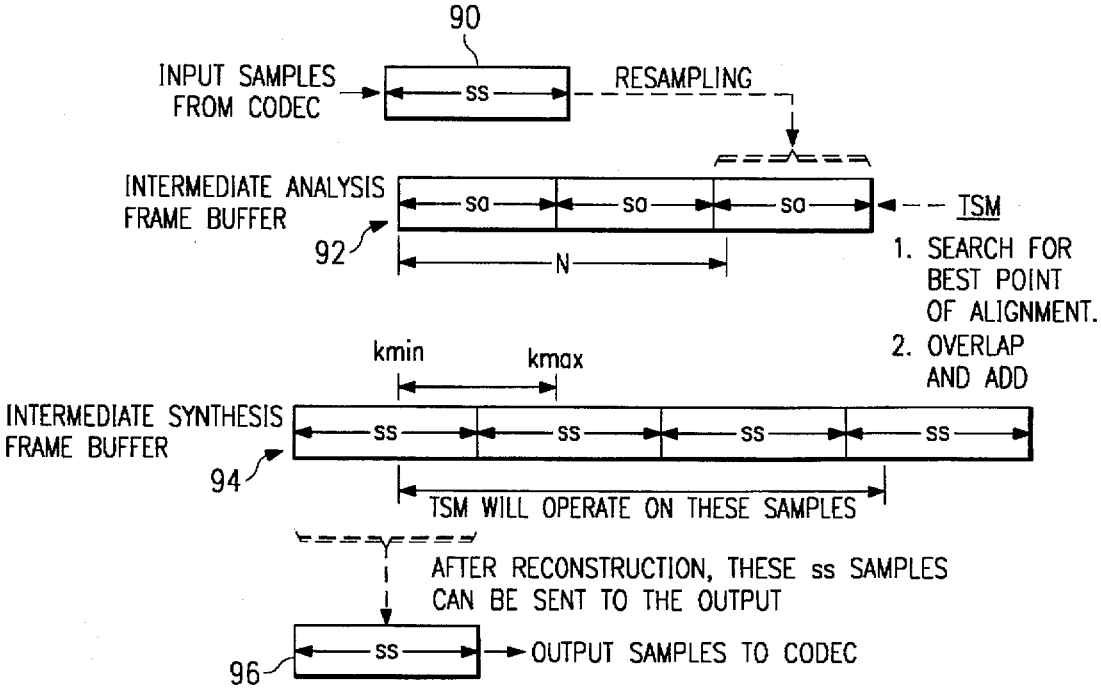
FIG. 9 illustrates a buffering scheme used in the implementation of the key shifting function shown in FIG. 8.

In the buffering scheme shown in FIG. 9, input buffer 90 and output buffers 96 are of size ss. Two intermediate frame buffers, 92 and 94, are also required for analysis and synthesis. The intermediate analysis frame buffer 92 stores at least three times sa (analysis frame length) samples from the input buffer 90, and the intermediate synthesis frame buffer 94 stores at least four times ss, the synthesis frame size, to reconstruct the time scale modified signal.

The TMS320C52 is a 16 bit fixed point digital signal processor. It includes a 32-bit arithmetic logic unit (ALU) with a 32-bit accumulator, a 16-bit multiplier with a 32-bit product capability, and a data memory which is accessed in word (16 bits) mode. Therefore, it is necessary to represent all variables in 16 bits. A Qn notation is adopted where n represents the number of bits allocated for the fractional part. For example, a signed floating point variable that varies between −2 to 1.9999 can be represented in Q14 format, where the 14 least significant bits (LSB) (bits $b_0, \ldots, b_3$) are used to represent the fractional part and 1 bit ($b_{14}$) is used to represent the integer and the most significant bit (MSB) (bit $b_{15}$) is used to represent sign. Some of the issues or problems involved in implementing the key-shifting function 84 in real time are discussed hereinbelow.

The fixed point resampling function developed by DVS (DEFINE). A few problems, such as overflow, occur however where the filtered output sometimes exceed $2^{15}$, and aligning occurs where the low pass filter used for limiting the signal bandwidth before or after down-sampling and up-sampling is inappropriate.

In the present invention, there are several points to consider. First the input and output samples. Second is the global and local similarity match. An additional point to consider is the overlap and add procedures. Since the codec provides samples in 16 bit linear format (i.e., from −32768 to 32767), the input and output samples are simply represented in Q15 format.

The search for the best point of time alignment, as discussed hereinabove, includes two steps. The first step, where a preliminary global search is performed to determine the number of zero crossing points and their differences between the input and output frame, involves only integer computations. However, some scaling is required to avoid overflow in the second step where a refined local search is performed which minimizes feature distance between the input and output. The distance metric, $d_i$, defined hereinabove, is the distance measure at the $i^{th}$ zero crossing point. The feature components are composed of differences between the input and output slopes and magnitudes. The Q format for these variables are selected based on statistical tests by plotting their dynamic ranges for a variety of input signals. They are summarized in Table 1 hereinbelow.

TABLE 1

Summary of Q format used for variables in feature distance computation.

| Description of Variables | Q Format |
|---|---|
| Slopes | Q14 |
| Differences between slopes | Q13 |
| Differences between magnitudes | Q13 |
| Total error distance ($d_i$) | Q12 |

In the first embodiment of the present invention discussed hereinabove, a raised cosine function was used for smoothing (or to cross-fade) the transition between two frames during overlap and add. However, in the fixed point implementation, a liner function is used in place of the raised cosine function to provide more efficient computation with no noticeable degradation for the test vectors used so far. The linear cross fade function is defined as:

Fade-in gain:

$$I[j]=\frac{j}{L},$$

where L is the overlapping interval and $0<j<L$

Fade-out gain:

$$1-I[j].$$

Figure 10A:
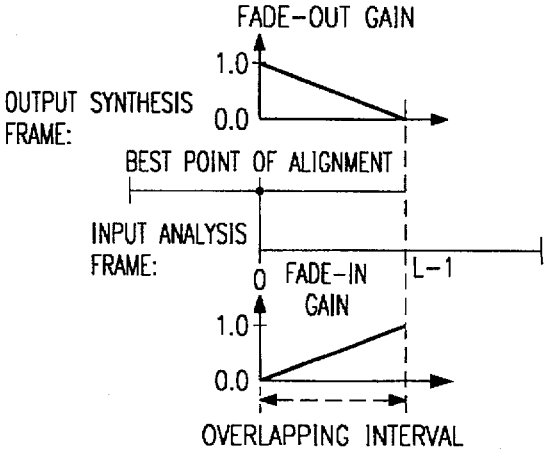
FIGS. 10A–10B show the cross-fade process used in the present invention.

FIG. 10A illustrates the cross fade process where the input analysis frame is fading in with a gain that varies from 0.0 to 1.0 and the output synthesis frame is fading out with a gain that ranges between 1.0 to 0.0 in the overlapping period. Since division is computationally costly on a DSP, $$\Delta=\frac{1}{L}$$

$\Delta=1/L$ is computed once for each frame and $j\times\Delta$ (where j is the time index) is computed for subsequent time indices instead of calculating $$\frac{j}{L}$$

each time. However, $\Delta$ can only be represented with a maximum of 15-bit precision. Therefore, there is no guarantee that $(L-1)\times\Delta$ will be close to $$\frac{L-1}{L}.$$

Figure 10B:
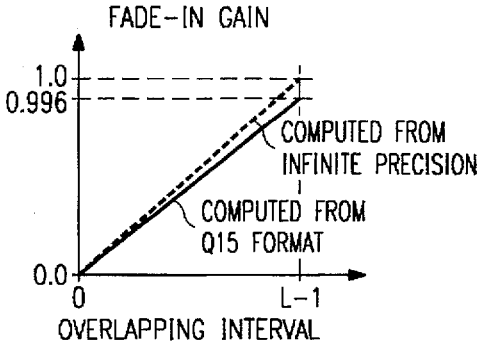

This discrepancy occurs much more often when L is large (at 44.1 kHz, L is often over 1500). When $(L-1)\times\Delta$ deviates from the true value $$\frac{L-1}{L}$$

by more than 0.002, the fade-in gain will not reach a value close enough to 1.0 at the end of the overlapping interval (see FIG. 10B) and the gain for the first sample after the overlapping interval will suddenly be 1.0. This leads to audible clicks around the points of concatenation in the time scaled signal. White noise spectra with low amplitude which spreads across the entire frequency band at the interval where concatenations take place are also observed in the spectrogram of the output signal. There are two approaches to solve this problem.

Figure 11A:
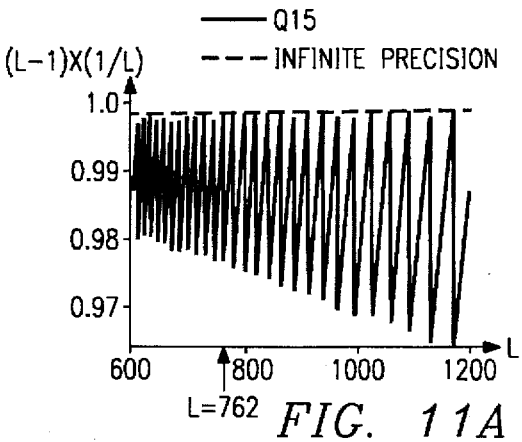
FIGS. 11A–11B depict plots of a value in Q15 format and in infinite precision.

The first approach is to set a ceiling to the overlapping interval. Plots for $(L-1)\times\Delta$ versus L in Q15 format and in infinite precision are shown in FIG. 11A. The peaks of the Q15 format curve indicate that the Q15 value is very close to the infinite precision value and the valleys indicate the opposite. From FIG. 11A, when L=762 (or 381, 585, or 1024), $(L-1)\times\Delta$ in Q15 is very close to the infinite precision value. Hence, if the ceiling is set to the overlapping interval such that $L'\leqq 762$ and since L is very likely to be larger than 762 at 44.1 kHz sampling rate, L' is set to 762 for most frames. Therefore, a smooth fade-in gain is assured. With this limitation on the overlapping interval L', reconstruction of the signal free of clicks and with very little degradation in quality is possible. When L'=381 (8.6 ms), or 585 (13.2 ms), singing voices with background music is not reproducible with very good audio quality. Furthermore, when L=1024 (23.2 ms) the quality is similar to L'=762 (17.2 ms). This approach also leads to another advantage where computations can be saved since the overlap and add procedure only requires at most 762×2 multiple-and-add instructions instead of the original L×2 (where L is often greater than 1500) multiply-and-add instructions.

Figure 11B:
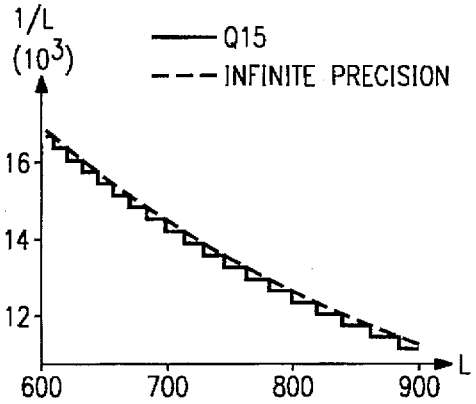

The second approach is to select a suitable value for the overlapping interval, i.e., select an overlapping interval L' to be as close to the original L as possible and $\Delta$ in Q15 to be close to the infinite precision value. In other words, choose L' to be the closest peak in the Q15 curve in FIG. 11A. The plots for $\Delta$ versus L in Q15 format and in infinite precision are shown in FIG. 11B. The Q15 curve has a staircase shape which shows that $\Delta$ in Q15 is always truncated to the next smaller whole number $$\left(\text{integer}\left(\frac{1}{L}\times 2^{15}\right)\right).$$

Figure 12:
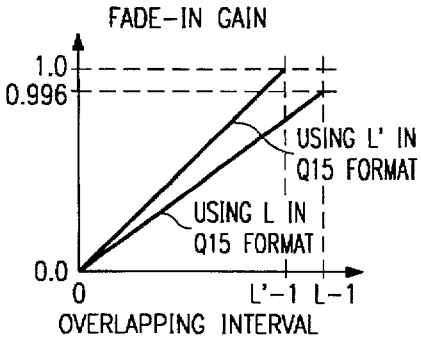
FIG. 12 depicts fade-in gain computed for a specified overlap interval.

Therefore, a simple way to reach the closest peak is by doing two divisions. That is, by computing $\Delta$ in Q15 and then finding the corresponding L' for this $\Delta$:

$$\Delta=\frac{1}{L}\ (\text{in } Q15)\text{ and } L'=\frac{1}{\Delta}$$

where L is the original overlapping interval, $\Delta$ is in Q15 and L' is the next closest peak in the Q15 curve (in FIG. 11A). The fade-in gain computed from the original L and from the modified L' in Q15 format is shown in FIG. 12. This method is capable of producing good audio quality for both singing voices and background music free of any audible artifacts.

In this second embodiment of the present invention, shown in FIG. 8, the resample function 80 and the TSM function 82 are combined into one module 84 for key-shifting. The problems with the fixed point resampling function have been identified and some of the issues required for real-time and fixed point implementations of the GLS-TSM have been solved. During this process, a number of insights have been gained. First of all, the performance of overlap and add process does not depend on the length of the exact overlapping interval. It only requires an interval long enough for the transition from one frame to the other. For singing voice mixed with music, a minimum 18 millisecond transition interval is required. Second, smoothing (or cross-fade) gain plays an important role in smoothing out the transition from one frame to the next. It is important to represent the fade-in gain in fixed point notation to be as close to the infinite precision notation as possible. Otherwise, audible clicks are noted when the fade-in gain does not reach a value close enough to 1.0 at the end of the overlapping period.

OTHER EMBODIMENTS

Although the present invention and its advantages have been described in detail, it should be understood that various changes, substitutions and alterations can be made herein without departing from the spirit and scope of the invention as defined by the appended claims.

What is claimed is:

1. A method of generating a time scale modification of a signal comprising the steps of:

determining zero crossing points in the signal using a zero crossing module;

determining feature vectors in neighborhood of said zero crossing points based on absolute magnitude and slope of sample points before and after zero crossing points using a feature vector module wherein each feature vector has j dimensions;

determining distance metrics associated with said zero crossing points using said feature vectors bases on accumulation of differences for each of the j dimensions, each of said distance metrics to measure closeness of local characteristics between two of said zero crossing points, using a distance metric module; finding minimum measure of said accumulation of differences for each of the dimensions; and aligning the signal along similar segments using said feature vectors and said distance metrics based on said minimum measure of said accumulation of differences for each of the j dimensions to achieve the time scale modification of the signal using said alignment module.

2. The method of claim 1 further including the step of smoothing transitions between successive frames in the time scale modification of the signal using a cross fading function.

3. The method of claim 1 wherein said aligning step includes the step of searching for said similar segments based on local similarity and similarity over a time interval.

4. The method of claim 1 wherein said aligning step includes the step of synchronizing the signal in accordance of a count of said zero crossing points and a minimum distance metric between two of said zero crossing points.

5. The method of claim 1 wherein said local characteristics include absolute magnitude and slope of sample points at the neighborhood of said zero crossing points.

6. The system of claim 1 wherein said each of said zero crossing points, Z, is determined using the equation $$Z = \sum_{m=1}^{m=L} |\mathrm{sgn}(x[m]) - \mathrm{sgn}(x[m+1])|$$

where sgn(x[m])=1 if x[m]>0 and where sgn(x[m])=0 if x[m]≦0.

7. A system for generating a time scale modification of a signal comprising:

a zero crossing module for determining zero crossing points in the signal;

a feature vector module coupled to said zero crossing module for determining feature vectors in neighborhood of said zero crossing points based on absolute magnitude and slope of sample points before and after zero crossing point;

said feature vector having j dimensions;

a distance metric module coupled to said feature vector module for determining distance metrics based on accumulation of differences for each of the j dimensions, said distance metrics indicating closeness of local characteristics between two of said zero crossing points;

means for finding minimum measure of said accumulation of differences for each of the j dimensions; and an alignment module coupled to said distance metric module for aligning said signal using said zero crossing points and said distance metrics based on said minimum measure of said accumulation of differences for each of the j dimensions to generate the time scale modification of the signal.

8. The system of claim 7 further including a cross fade module coupled to said alignment module for smoothing transitions between successive frames in the time scale modification of the signal.

* * * * *